United States Patent [19]

Läeuppi et al.

[11] Patent Number: 4,798,495

[45] Date of Patent: Jan. 17, 1989

[54] APPARATUS FOR INSERTION OF REINFORCEMENT RODS IN A CONCRETE ROAD SURFACE

[75] Inventors: Heinrich Läeuppi, Graenichen; Paul Rapp, Erlenbach, both of Switzerland

[73] Assignee: Erhard Thoma, Gartringen, Fed. Rep. of Germany

[21] Appl. No.: 30,880

[22] Filed: Mar. 26, 1987

[30] Foreign Application Priority Data

Mar. 27, 1986 [CH] Switzerland ..... 1243/86

[51] Int. Cl.[4] ..... E01C 23/04

[52] U.S. Cl. ..... 404/100; 404/88

[58] Field of Search ..... 404/88, 100, 87, 74

[56] References Cited

U.S. PATENT DOCUMENTS 2,295,947 9/1942 Heltzel ..... 404/88
2,399,025 4/1946 Heltzel ..... 404/88
4,433,936 2/1984 Moser ..... 404/100 X

FOREIGN PATENT DOCUMENTS 154761 9/1985 European Pat. Off. ..... 404/100

*Primary Examiner*—Jerome W. Massie, IV
*Assistant Examiner*—Matthew Smith
*Attorney, Agent, or Firm*—Wolf, Greenfield & Sacks

[57] ABSTRACT

The apparatus (20) is vertically and adjustably placed on the girders (2b) of the sheet piling equipment (1). It has a slab (21) with apertures (26) parallel to the direction of movement. A vibrating beam (60) is vertically and adjustably placed on the slab (21) between two supports (51, 52). Fasteners (28) are arranged on the apertures (26) for the reinforcement rods (22). The (60) beam is lowered by means of prongs (62). The prongs (62) surround the reinforcement rods (22) and ease them into the road surface (6). After lifting the beam (60) with the prongs (62), the slab (21) is moved back and forth horizontally to the apertures (26), then lifted and pulled back up to the equipment (1). Thus, any irregularities caused by installation of reinforcement rods (22) can be eliminated.

4 Claims, 4 Drawing Sheets

APPARATUS FOR INSERTION OF REINFORCEMENT RODS IN A CONCRETE ROAD SURFACE

Concrete road surfaces are usually made with sheet piling equipment. In order for the surface to properly withstand heat expansion, joints are formed in regular distances of approximately five meters apart. The easiest method to form so-called rail joints is by pressing horizontal grooves into the surface. When the tensile strength of concrete is surpassed, cracks form along these grooves which then compensate for slabs divided through further heat expansion. These individual slabs are then connected to each other by means of reinforcement rods in order to avoid warping and to allow them to withstand sufficient weight. The rods usually have a length of 50 cm and are set vertically at a distance of 50 cm apart.

The present invention is recommended for use in setting a movable slab on the freshly laid road surface which has apertures for the reinforcement rods to be installed. This movable slab is swung by means of rods protruding from the back of supporting beams. A horizontal hydraulic cylinder connects the movable slab with the equipment. Vibrators are placed on a crossbeam which is adjustable in height by means of vertical hydraulic cylinders. Pegs are fastened with tongs over the apertures and pressed with prongs into the concrete. Pressure occurs through the vertical cylinders. This movable slab should prevent concrete from dislodging when dowels are placed in position. When dowels are inserted, the movable slab remains in place while the equipment continues at a constant rate of speed. The slab is then brought forward through the horizontal cylinder from the end of the surface. Through the action of the slab and the swinging motion of the parallel driving of this slab, a horizontal pattern is impressed into the road surface which is unable to be smoothed out in following operations and can be unpleasant when driving on the finished road.

A better variation is as follows. The slab is securely moved with the beam into a vertical direction and can be suspended above the road surface. Thus, an unintentional pattern on the road surface can be avoided.

In both of the above mentioned variations, small mounds of concrete must be smoothed out in a horizontal motion around the area in which the reinforcement rods are placed. This is accomplished by the characteristics of claim 1.

Because the slab is adjustable by means of first and second suspension elements, it can be pulled back and forth after insertion of the rods and then lifted onto the equipment without resting on the road surface. The mounds caused by inserting the rods can be smoothed out by the widening edges of the apertures and the surface underneath the moving slab. Smoothing the surface with a crossbeam is therefore unnecessary. The equipment itself is simpler and the work more cost-effective. Another important advantage is that smaller equipment can be used.

The following drawing is an illustrative example of the invention.

Figure 1:
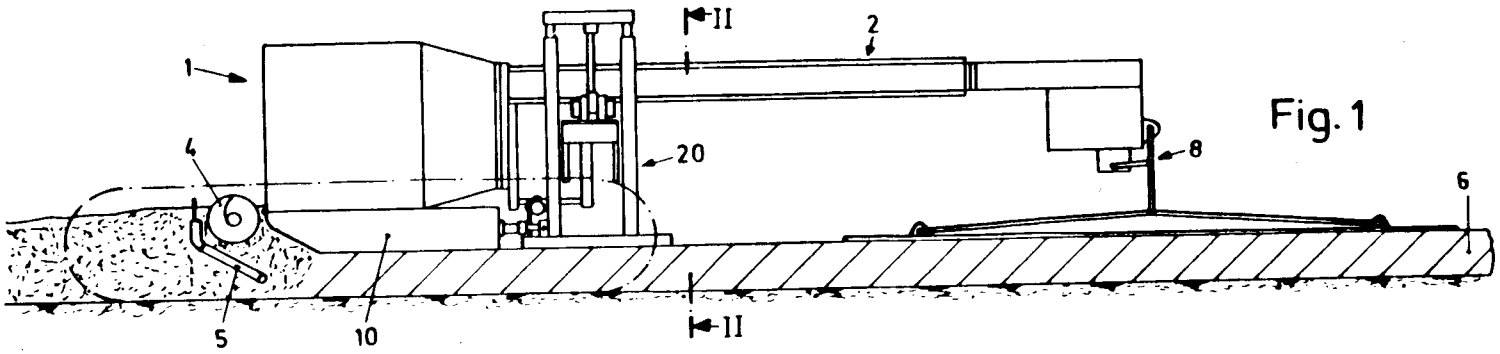
FIG. 1 illustrates a side view of a road construction machine with a device to install reinforcement rods.

FIG. 1 schematically illustrates adjustable sheet piling equipment 1. Distributors 4 are found on the front of the device to spread the freshly poured concrete over the surface to be constructed. Vibrators are set under the distributors to force the concrete out. The concrete is pressed with a slab 10. A supporting frame is placed on one of the back ends of the device 1 to insert the reinforcement rods. This device will be more fully described in the text to follow. Behind this apparatus 20 is a smoothing device 8 with an adjustable smoother.

Figure 3:
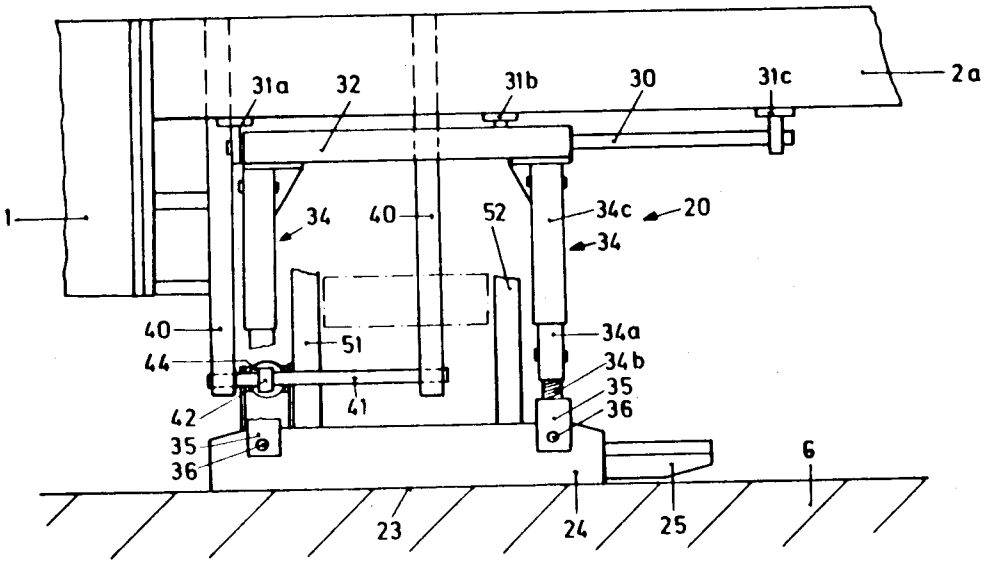
FIG. 3 illustrates a view along the angle III—III in FIG. 2.
Figure 2:
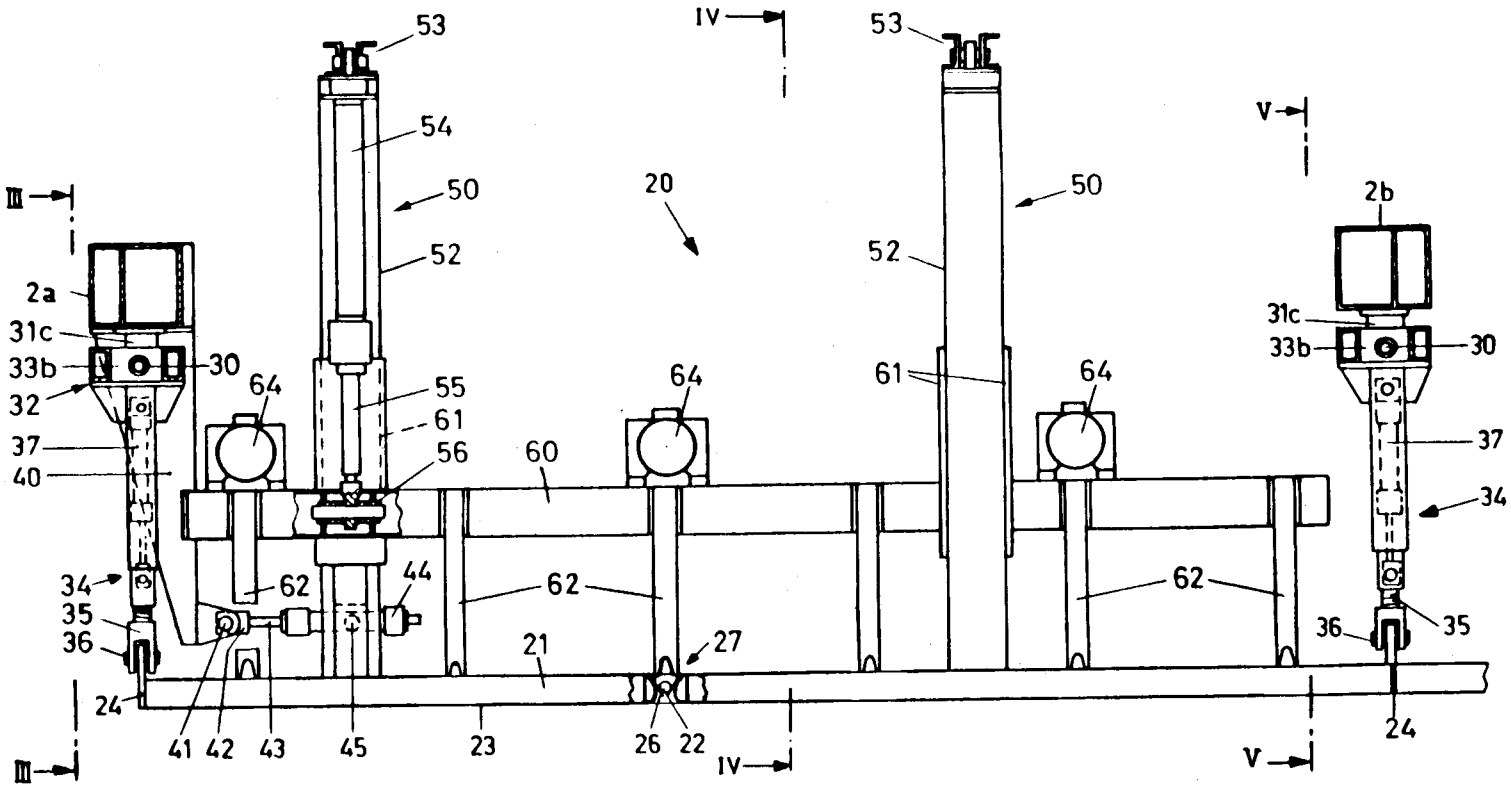
FIG. 2 illustrates a view along the angle II—II in FIG. 1.
Figure 4:
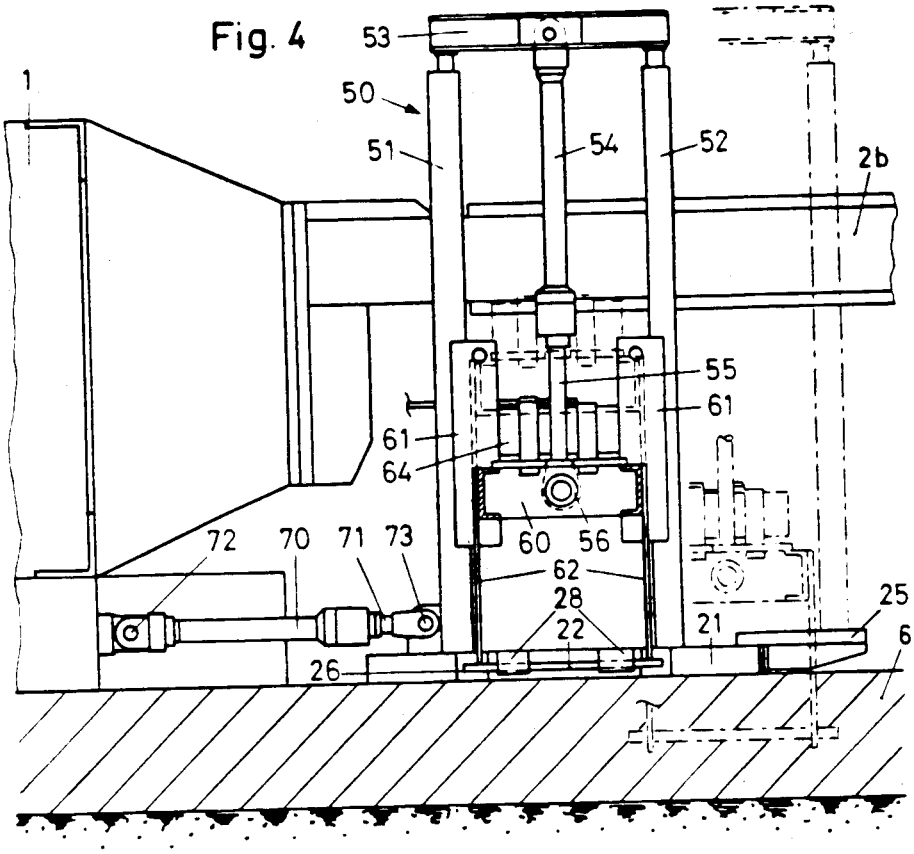
FIG. 4 illustrates a view along the angle IV—IV in FIG. 2.
Figure 5:
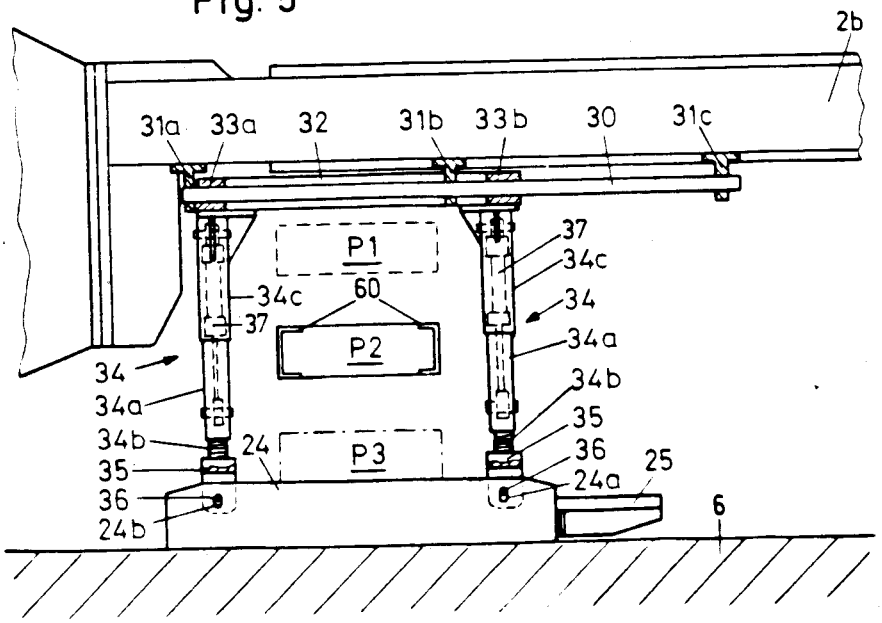
FIG. 5 illustrates a view along the angle V—V in FIG. 2.
Figure 6:
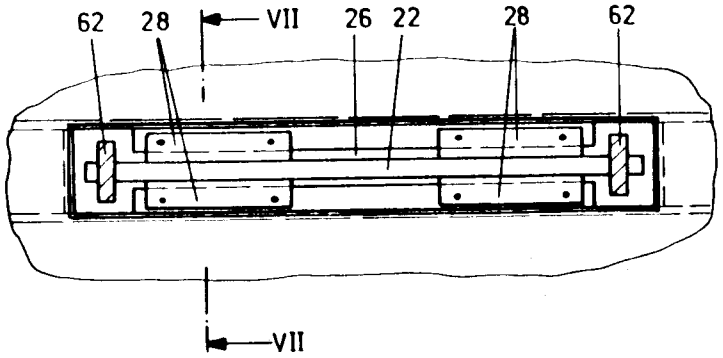
FIG. 6 illustrates the view from above the aperture in the surface.

FIG. 2 illustrates the device 20 for insertion of the reinforcement rods observed from the angle II—II in FIG. 1 and thus in the direction of the road construction. The device 20 consists of two halves placed side by side. In order to show a better view, the half found symmetrically right of the middle rod 2*b* of the framework 2 is not shown. Views across this illustration and thus in levels parallel to the direction of installation are shown in FIGS. 3, 4 and 5.

On the back of a long, ashlar-formed surface 21 with hollow construction, a runway 25 is secured to the underside 23 to support workmen. Upright transverse joints 24 are provided with vertical bores. On each of the three rods 2*a*, 2*b* of the framework 2 a rod 30 is securely fastened by means of three equidistant T-profile pieces 31*a*, 31*b* and 31*c*. A rectangular framework serving as a sliding element 32 is provided with sliding bearings 33*a* and 33*b* in both of the shorter sides and slides on the reinforcement rod. These bearings 33*a*, 33*b* can be made of a smooth plastic, such as polyamide.

Two telescopic columns 34 are fastened rigidly on the shorter sides of this rectangular framework 32. Each of these columns 34 have a U-formed container 35 beneath them which covers the groove 24 on the surface 21 on both sides and is adjustably connected by means of a bolt 36 through apertures 24*a*, 24*b*. Each column 34 consists of a housing 34*a* with interior windings in a spindle 34*b* as shown in FIG. 5. The length of the column 34 can be adjusted by turning the housing 34*a*. The housing 34*a* is inserted into a further housing 34*c*. Both housings 34*a* and 34*c* are telescopic by means of a hydraulic cylinder 37. Thus, the slab 21 can be lifted from the road surface and set upon it without sliding on the road surface 6 when the machinery is moved.

Through vertical apertures 24*a* and 24*b*, columns 34 are swiveled around an axle parallel to the axle of the rods 30 and fastened to slab 21. Frames 32 are swiveled around the rods 30. Thus columns 34, slab 21 and the connecting line between the rods form a parallelogram. A further rod 41 is connected parallel to the rods 30 under a support 2*a* from which protrude two arms 40. The open end of a piston rod 43 of a hydraulic cylinder 44 is adjustable. The cylinder 44 is connected with a supporting column 51 fastened on the slab 21 and swiveling around a horizontal axle 45. Slab 21 can be slid by means of cylinder 44.

As seen in FIG. 2 between the exterior beams 2*a* and 2*b* two yoke-formed supports 50 are fastened rigidly on the slab 21. These supports 50, from which one is shown from the side in FIG. 4, consist of two supporting columns 51 and 52 which carry a yoke beam 53. A vertical hydraulic cylinder 54 is driven in the middle of this yoke beam 53. The open end 56 of the corresponding piston 55 is connected by means of a vibrating beam 60. The vibrating beam 60 is formed as a rectangular frame of interconnected U-formed supports. The longer sides are approximately as long as the slab 21 and the shorter sides are shorter than the distance between the two supporting columns 51 and 52. Vertically longer surfaces 51 lead the vibrating beam 60 to the supporting columns 51 and 52.

Pairs of prongs 62 are fastened in equal distances of 50 cm, for example, on the vibrating beam 60. Three vibrators 64 are placed on this beam, perhaps in the form of electrical motors with fulcrum disks on the motor spindles or hydraulic vibrators.

Figure 7:
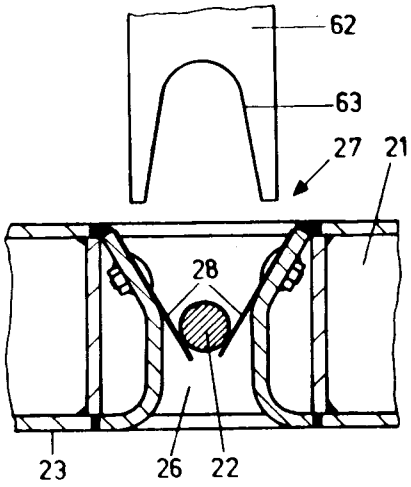
FIG. 7 illustrates a view along the angle VII—VII in FIG. 6.

The pairs of prongs 62 are directed toward the apertures 26 in the slab 21. Funnels 27 are placed in the aperture 26 to hold the reinforcement rods. These funnels 27 consist of two pairs of springs 28 as particularly illustrated in FIG. 7. Springs 28 reach into the apertures 26 so that the lower end of the funnel 27 is near the underside 23 of slab 21. Springs 28 are distanced underneath somewhat less than the diameter of the reinforcement rods 22. The prongs 62 have an aperture 63 extending on their lower end to hold the rod 22, whereby aperture 63 is approximately as long as the distance of the bottom of funnel 27 from the bottom 23 of slab 21. This prevents the reinforcement rod 22 from sinking during insertion of the prongs 62 after release of rods 22 from funnel 27. The aperture 26 is rounded on its lower end 23 so that the concrete is not obstructed during horizontal displacement of surface 21.

One can also see a horizontal hydraulic cylinder 70 in FIGS. 1 and 4. A second such cylinder on the right half is not shown in FIG. 2 near the symmetrically place support 20. This cylinder 70 is driven by means of a first joint 72 on the smoothing equipment. Piston 71 is driven by one of the supports 50 with a second joint 73. Both sides of the cylinder are connected with the recoil by a valve, so that the device 20 can slide back and remain in place while the reinforcement rods 22 are inserted after insertion of the device 20 by means of the cylinder 70.

A steering stabilizer can be provided to ensure that on the one hand the cylinders 54 move synchronously in the four supports 50 left and right of the middle support 2*b*, and on the other hand both horizontal cylinders 70 as well as cylinder 37 are synchronized.

Before insertion of reinforcement rods 22 cylinders 70 are placed in the position illustrated by FIG. 4. Cylinders 54 and 37 are also in the inserted position. Thus, vibrating beam 60 is found in the position shown by P1 in FIGS. 4 and 5, as shown in dotted lines in FIG. 4, and the prongs 62 are found placed over slab 21.

A workman now lays a reinforcement rod 22 in each funnel 27. Shortly before reaching the next closest seam, vibrating beam 60 is driven into position shown as P2 in FIG. 5 by means of cylinder 54. This position is illustrated in FIG. 4 with dotted lines. Prongs 62 touch the reinforcement rods 22 in the funnels 27.

On the area to be formed, slab 21 is first lowered onto the road surface by means of cylinder 37. Then the cylinders 54 are smeared with compression oil and the prongs 62 press the reinforcement rods 22 down out of the supporting funnels 27. Upon contact with the road surface 6, cylinders 70 and 54 are supplied to overcome friction with minimum pressure. Simultaneously, vibrators 64 are turned on and prongs 62 transfer vibrations onto the rods 22. Under this influence, the area of concrete softens and the rods sink into the road surface.

As soon as the vibrating beam 60 reaches the area P3 in FIG. 5, vibrators 64 are switched off and beam 60 with the prongs 62 is drawn up by means of the cylinder 54 into the area P1 in FIG. 5.

Then, by means of cylinder 44, slab 21 is moved transversely a distance somewhat more than the width of aperture 26. The irregularities caused by installation of the rods 22 are therefore smoothed out. Finally, the slab 21 is lifted with the cylinders 37 and pulled to the apparatus 1 with cylinder 70.

We claim:

1. Device for insertion of reinforcing rods (22) at locations for transverse joints in a newly-laid concrete road surface (6), encompassing a support (2*a*), a longitudinal guide (30) attached to the support (2*a*), a slide (32) which is movable along the longitudinal guide (30), a plate (21) attached to the slide (32), adjustable in height with respect to the slide (32), with slots (26) in the plate disposed parallel to the guide (30), and with holding means (27, 28) for the reinforcing rods (22) attached to the plate 921) in the vicinity of the slots (26), and with a vibration beam (60) which can be displaced vertically above the plate (21) with forks (62) to vibrate the reinforcing rods (22) during insertion, unique in that the plate (21) can be moved horizontally, transversely with respect to the guide (30) by a first piston element (44) attached to support (2*a*) and disposed transverse to the direction of the slots, the plate (21) can be raised by a second piston element (37), and the slots (26) have a lowermost portion at the underside of the plate and an adjacent portion above the lowermost portion, the lowermost slot portion being wider in the direction transverse to the guide (30) than the adjacent slot portion, wherein following insertion of the rods into the newly-laid concrete surface at a first joint location the plate (21) is moved transversely to smooth over the surface where the rods are inserted, the widened slots facilitating such smoothing, and the plate is then raised by the second piston element (37) above the road surface for transport to the next joint location.

2. Device according to claim 1, unique in that the forks (62) have a vertical slot recess (63) at the lower end, and in that the length of this recess 963) approximately corresponds to the distance between the lower edge of the holding means (27, 28) and the underside (23) of the plate (21), wherein the forks (62) prevent the rods (22) from rolling away transversely on the concrete surface.

3. Device according to claim 1, unique in that the guide is at least two cylindrical bars (30), the slide is at least two sliding elements (32) each of which can slide longitudinally on and rotate around one of the cylindrical guide bars 930), and in that there are at least two second piston elements each connected at one end to one of the sliding elements (32) and each rotatably attached at the other end to the plate (21) around an axis parallel to the guide bars.

4. Device for insertion of reinforcing rods (22) at locations for transverse joints in a newly-laid concrete road surface (6), encompassing a support (2*a*), at least two longitudinal cylindrical guide bars (30) attached to the support (2*a*), at least two sliding elements (32) each of which is slidable along and rotatable around one of the longitudinal guide bars (30), a plate (21) attached to the sliding elements (32), adjustable in height with respect to the sliding elements (32), with slots (26) extending through the plate that are disposed parallel to the guide bars (30), and with holding means (27, 28) for the reinforcing rods (22) attached to the plate (21) in the vicinity of the slots (26), and with a vibration beam (60) which can be displaced vertically above the plate (21) with forks (62) to vibrate the reinforcing rods (22) during insertion, unique in that the plate 921) can be moved transversely with respect to the guide bars (30) by a first piston element (44) slidably attached to at least one arm (40) that projects from support (2*a*), said at least one arm carrying a guide rod (41) extending parallel to the guide bars (30), said rod (41) carrying slidably one end (42) of the first piston element (44), and said first piston element (44) being pivotably connected to the plate (21), in that the plate (21) can be raised by at least two second piston elements (37) connecting the plate and sliding elements 932), and in that the slots (26) have a lowermost portion at the underside of the plate and an adjacent portion above the lowermost portion, the lowermost portion being wider in the direction transverse to the guide bars (30) than the adjacent slot portion, wherein following insertion of the rods into the newly-laid concrete surface at a first joint location the plate (21) is moved transversely to smooth over the surface where the rods are inserted, the widened slots facilitating such smoothing, and the plate is then raised by the second piston elements (37) above the road surface for transport to the next joint location.

* * * * *

UNITED STATES PATENT AND TRADEMARK OFFICE

CERTIFICATE OF CORRECTION

PATENT NO. : 4,798,495

DATED : January 17, 1989

INVENTOR(S) : Laeuppi et al.

It is certified that error appears in the above—identified patent and that said Letters Patent is hereby corrected as shown below:

Col. 4, line 25 - change "921" to -- (21) --.

Col. 4, line 47 - change "963" to -- (63) --.

Col. 4, line 57 - change "930" to -- (30) --.

Col. 5, line 9 - change "921" to -- (21) --.

Col. 6, line 3 - change "932" to -- (32) --.

Signed and Sealed this

Thirtieth Day of May, 1989

*Attest:*

*Attesting Officer*

DONALD J. QUIGG

*Commissioner of Patents and Trademarks*